US005199676A

United States Patent [19]

Kowalewski

[11] Patent Number: 5,199,676

[45] Date of Patent: Apr. 6, 1993

[54] ADJUSTABLE WATER HEATER STAND

[75] Inventor: Ronald A. Kowalewski, Brookfield, Wis.

[73] Assignee: AOS Holding Company, Wilmington, Del.

[21] Appl. No.: 849,929

[22] Filed: Mar. 11, 1992

[51] Int. Cl.[5] ..... A47G 23/02

[52] U.S. Cl. ..... 248/149; 248/146; 248/172

[58] Field of Search ..... 248/676, 146, 149, 346, 248/172, 174, 173, 152; 220/633, 636, 638

[56] References Cited

U.S. PATENT DOCUMENTS

| | | | |
|---|---|---|---|
| 834,377 | 10/1906 | Foster | 248/173 |
| 839,062 | 12/1906 | Gagnon | 248/172 |
| 860,063 | 7/1907 | Sanders | 248/172 |
| 1,321,305 | 11/1919 | Heald | 248/172 |
| 3,124,110 | 3/1964 | Buehl | 248/146 X |
| 4,006,850 | 2/1977 | Farina | 248/146 X |
| 4,344,645 | 8/1982 | Kirk | 248/146 X |
| 5,085,387 | 2/1992 | Peterson | 248/676 X |

*Primary Examiner*—J. Franklin Foss
*Attorney, Agent, or Firm*—David R. Price

[57] ABSTRACT

An adjustable water heater stand including three substantially identical support members each fabricated from sheet metal. The support members each include a central sheet section, an outer leg for supporting the stand and an inner end portion extending at a 60° angle from the sheet section. The support members are positioned with their inner end portions abutting the sheet section of an associated support member so that the sheet sections form an equilateral triangle. The triangle is contracted or expanded to adjust the stand to accomodate variously sized water heaters, and fasteners are used to secure the support members in the desired arrangement.

17 Claims, 3 Drawing Sheets

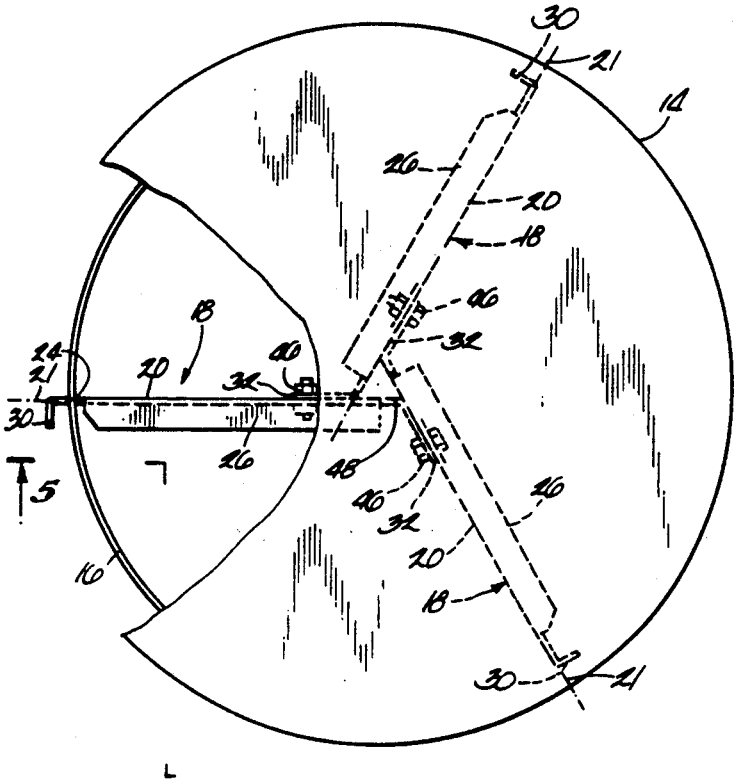
Fig. 4
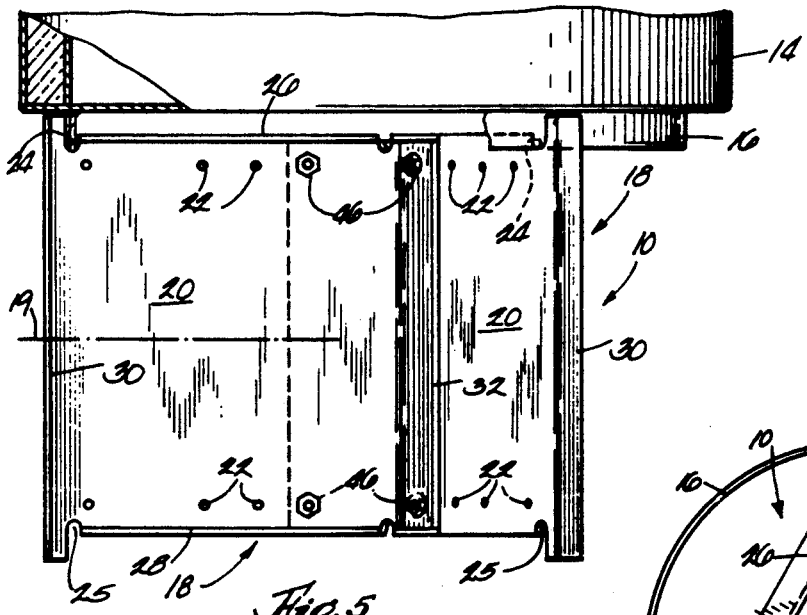
Fig. 5
Fig. 6
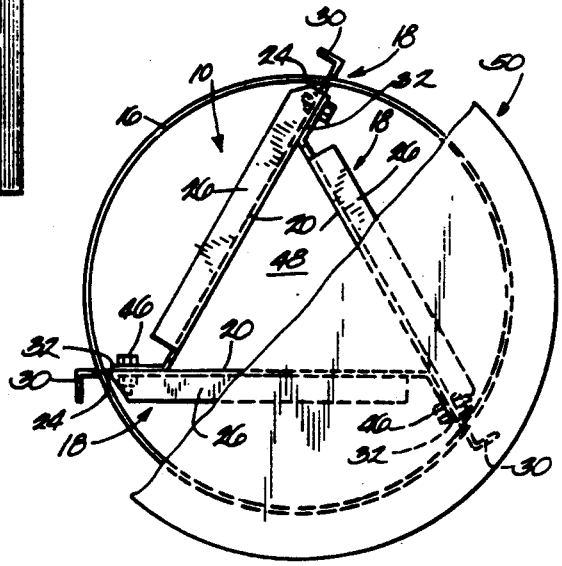

ADJUSTABLE WATER HEATER STAND

BACKGROUND OF THE INVENTION

The invention relates to cylinder stands, and more particularly to adjustable stands for residential water heaters.

For safety reasons, a residential water heater may be mounted on a stand to raise the water heater above the ground. A known stand, which is illustrated in FIG. 1, includes upper and lower central members 1 and 2 and three leg members 3 that can be adjustably positioned and secured relative to the central members so as to accommodate water heaters of different sizes. Such an adjustable stand is sold as Part No. 21029 by Master-Fit Company of Chicago, Ill.

SUMMARY OF THE INVENTION

The invention provides an adjustable water heater stand that is relatively inexpensive to manufacture because it has a minimum number of different parts and the main parts have a simple construction.

More particularly, the invention provides a water heater stand comprising three identical members that are made of sheet metal and that are secured together by suitable fasteners such as nuts and bolts. The members are connected in one way to support a water heater with a twenty-inch tank and are connected in another way to support a water heater with a fourteen-inch tank. In both cases, the sheet-like members are oriented vertically and define an equilateral triangle. Each member has an inner end fixed to one of the other members, and the only difference between the two arrangements is the point on each member at which the associated member is connected. Preferably, each member includes a downwardly extending, integral leg portion supporting the remainder of the member above the ground, and each member includes an upwardly opening groove that receives the base of the water heater. The members are preferably symmetrical so that the stand is invertible.

The stand is simple and inexpensive to construct because the three members are identical and are fabricated from sheet metal, and because the entire stand comprises only the three sheet metal members and the fasteners.

Other features and advantages of the invention will become apparent to those skilled in the art upon review of the following detailed description, claims and drawings.

DESCRIPTION OF THE DRAWINGS

FIG. 4 is an enlarged top plan view, partially broken away, of the water heater and stand shown in FIG. 2.

FIG. 5 is a view taken along line 5—5 in FIG. 4.

FIG. 6 is a view similar to FIG. 4 and showing the stand in an alternative arrangement to support a smaller water heater.

Figure 1:
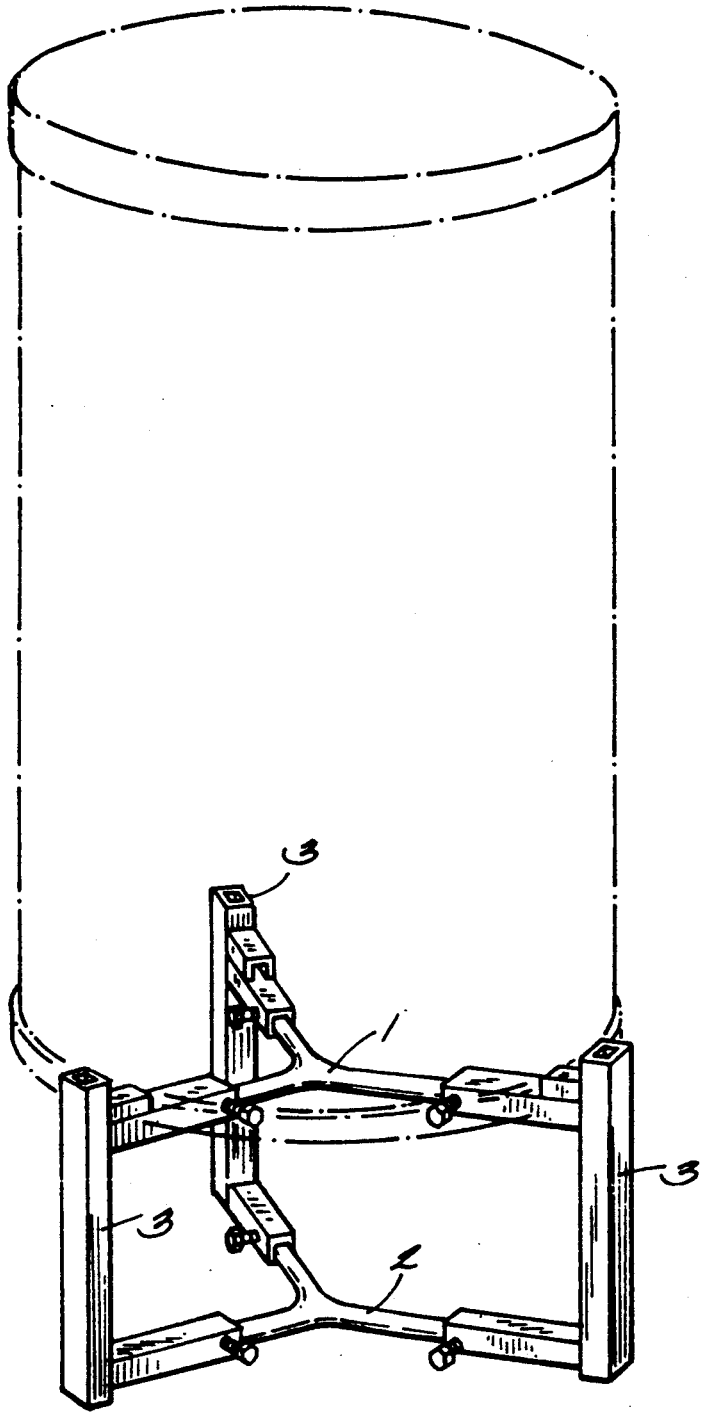
Fig. 1 PRIOR ART
FIG. 1 is a perspective view of a prior art water heater stand.
Figure 2:
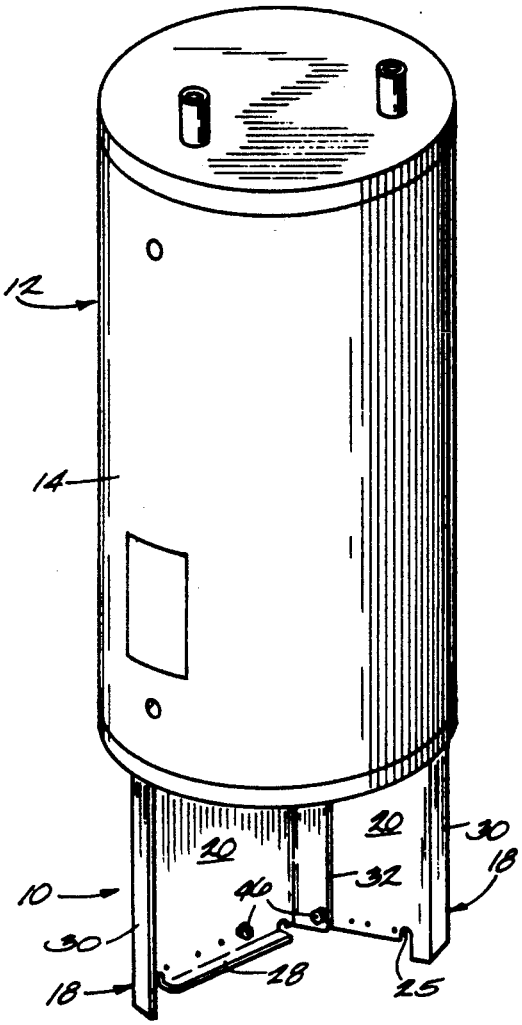
FIG. 2 is a perspective view of a water heater supported by a stand embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in FIGS. 2–6 is a stand 10 which embodies the invention and which is used to support a residential water heater above the ground. In the illustrated arrangement, the water heater 12 is a standard twenty-inch diameter water heater and includes a generally cylindrical tank 14 having (see FIGS. 4–6) an annular base or rim 16 (see FIG. 5) depending therefrom. As is further explained below, the stand 10 is adjustable to accomodate water heaters of various sizes.

While in the illustrated arrangement the stand 10 is used to support a residential water heater 12, it should be understood that a stand embodying the invention could also be used in other applications to support objects other than residential water heaters.

Figure 7:
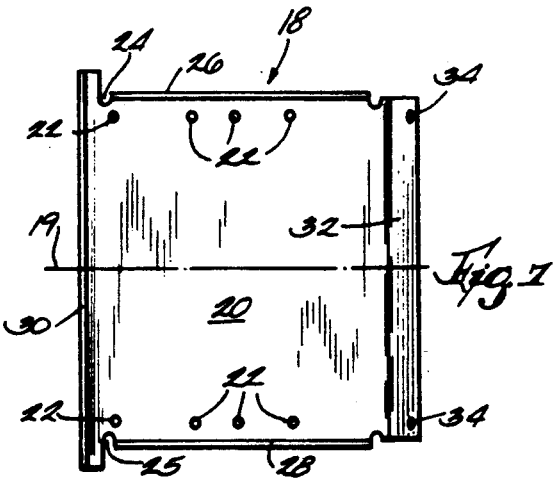
FIG. 7 is a reduced side elevational view of one of the three main components of the stand shown in FIGS. 2–6.

More specifically, the stand 10 comprises three generally identical support members 18 each preferably fabricated from a single sheet of material. As shown in FIG. 7, each support member 18 has a longitudinal axis 19 and is symmetrical about the axis 19. Each support member 18 includes a substantially planar sheet section 20 that is generally vertically oriented when the stand 10 is in an upright position. The sheet section 20 includes a plurality of holes 22 preferably arranged at spaced intervals and in two rows which are parallel to the axis 19 and which are adjacent the upper and lower edges of the sheet section 20. The sheet section 20 also includes upper and lower slots or grooves 24 and 25 for receiving the rim 16 of the water heater 12, as is further explained below. To impart rigidity to the sheet section 20, each support member 18 is provided with upper and lower flanges 26 and 28 respectively extending normally from the upper and lower edges of the sheet section 20.

Each support member 18 also includes an integral leg 30 at the outer end thereof. The leg 30 of each support member 18 is positioned outwardly of the grooves 24 and 25 in the corresponding sheet section 20 and extends both downwardly from the lower edge of the sheet section 20 and upwardly from the upper edge of the sheet section 20. Thus, each support member 18 includes a downwardly extending integral leg portion and an upwardly extending integral leg portion. Each of the support members 18 also includes an angled inner end portion 32 that is positionable in flat, abutting relation with an associated support member 18 along the sheet section 20 thereof. The inner end portion 32 of each support member 18 preferably forms an angle of about 60° with the corresponding sheet section 20 and includes (see FIG. 7) a pair of holes 34. Each of the holes 34 lies in the same horizontal plane as one of the rows of holes 22.

Figure 8:
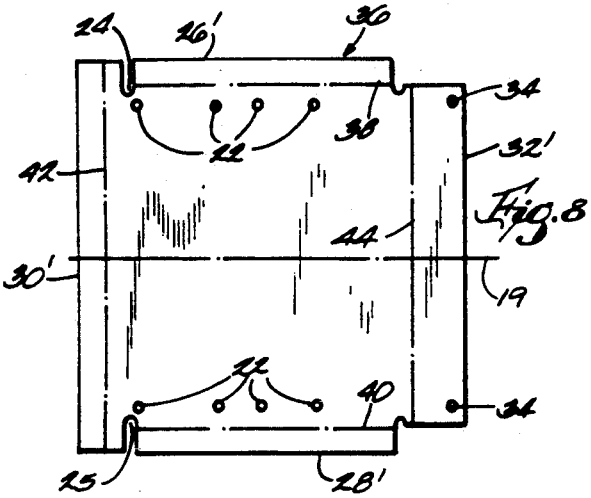
FIG. 8 is an elevational view of a blank used to form the component shown in FIG. 7.
Figure 3:
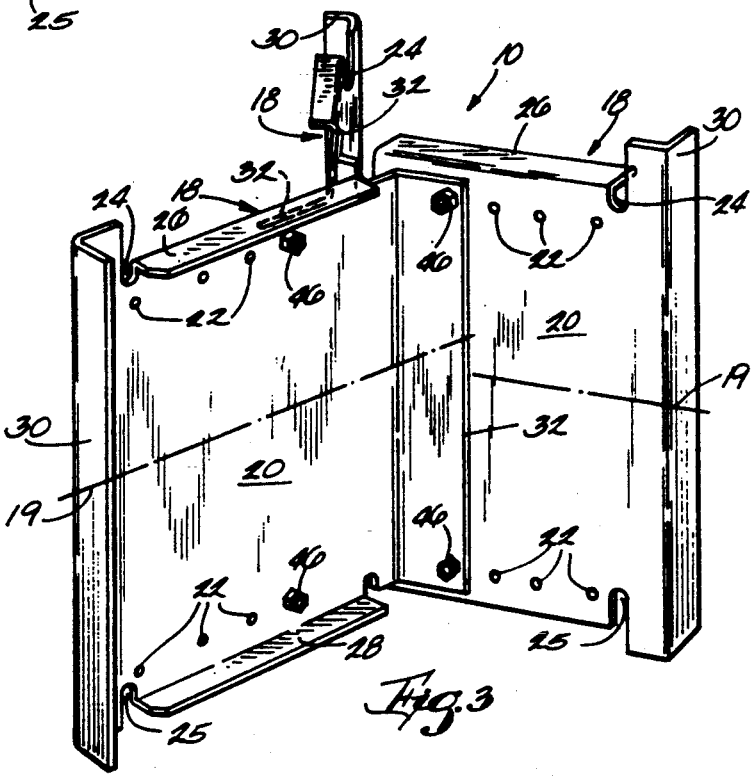
FIG. 3 is an enlarged perspective view of the stand shown in FIG. 2.

Fabrication of one of the support members 18 from a single sheet of material is described with reference to FIG. 8. More particularly, the sheet material used is preferably 14-gauge sheet metal, although other materials and material thicknesses could also be employed. Formation of a support member 18 begins with the provision of a sheet metal blank 36 cut generally as shown in FIG. 8 and including the holes 22 and 34 and the grooves 24 and 25. The blank 36 is thereafter permanently deformed in a press or by other suitable means to provide the desired support member configuration. Specifically, the sheet portions 26', 28' and 30' are bent perpendicularly to the remainder of the blank 36 along lines 38, 40 and 42, respectively, to form the upper and lower flanges 26 and 28 and part of the leg 30. Similarly, the sheet portion 32' is bent at a 60° angle along the line 44 to form the inner end portion 32.

The stand 10 also comprises means for securing the support members 18 in a desired arrangement to support the water heater 12. While various securing means can be used, in the illustrated construction the securing means includes a plurality of fasteners 46, such as nuts and bolts, so that the stand 10 is selectively adjustable by a user.

In FIGS. 4 and 5, the support members 18 are shown in a first arrangement to accomodate the twenty-inch diameter water heater 12. In particular, the holes 34 in the inner end portions 32 of the support members 18 are aligned with selected holes 22 adjacent the inner ends of the associated members 18. The fasteners 46 are inserted through these aligned holes 22 and 34 to connect the support members 18 together in the desired arrangement. Thus, in the first arrangement, each of the support members 18 is connected to the associated member 18 at a first point adjacent the inner end of the associated member 18. When the support members 18 are assembled, the longitudinal axes 19 of the support members 18 define a generally horizontal plane and define the sides of an equilateral triangle indicated generally by the reference numeral 48 (see FIG. 4). In other words, the support members 18 intersect a horizontal plane to define an equilateral triangle 48.

To support the water heater 12 on the stand 10, the water heater 12 is simply placed on top of the stand 12 so that the rim 16 is recieved in the upwardly opening grooves 24 (see FIGS. 4 and 5). The upwardly extending leg portions of the legs 30 of the support members 18 further aid in retaining the water heater 12 firmly on the stand 10.

Adjustment of the stand 10 to support water heaters having different widths or diameters is explained with respect to FIG. 6, wherein the support members 18 are shown in a second operative arrangement to support a standard fourteen-inch diameter water heater 50. To accommodate the smaller water heater 50, the fasteners 46 are removed and the inner end portions 32 are moved outwardly to expand the triangle 48 and to align the holes 34 with selected holes 22 more closely adjacent the outer ends of the associated members 18. The support members 18 are then secured in this arrangement by the fasteners 46. Thus, in the second arrangement, each of the support members 18 is connected to the associated member 18 at a second point (spaced from the above-mentioned first point) adjacent the outer end of the associated member 18. It is preferred that the holes 22 be spaced apart to correspond to standard water heater sizes, and the stand 10 can be adjusted to a desired arrangement by simply expanding or contracting the triangle 48.

Advantageously, the stand 10 is readily adjustable to accommodate water heaters of various sizes and can be easily assembled from three identical support members 18 that are easily and inexpensively fabricated from a single piece of sheet metal. The entire stand 10 consists of only the three support members 18 and the fasteners 46. Also, the stand 10 is invertible because the members 18 are symmetrical about their axes 19.

Other features and advantages of the invention are set forth in the following claims.

I claim:

1. A stand for supporting water heaters of various sizes, said stand comprising of three substantially identical members which, in a first arrangement, support a water heater having a first width, and which, in a second arrangement, support a water heater having a second width, each of said members including a substantially planar and generally rectangular main portion having first and second parallel edges, and third and fourth parallel edges, a first flange extending generally perpendicularly from said main portion along said first edge, and an attachment flange extending at an angle of less than 90° to said main portion from said edge, each of said attachment flanges being connected to an associated one of said members at a first point in said first arrangement, and each of said attachment flanges being connected to said associated one of said members at a second point in said second arrangement, and a plurality of fasteners for securing said attachment flanges to said members in either of said first and second arrangements.

2. A stand as set forth in claim 1 wherein said main portion of each of said members extends substantially vertically.

3. A stand as set forth in claim 2 wherein said main portions, in both of said first and second arrangements, define a substantially equilateral triangle.

4. A stand as set forth in claim 3 wherein, in said first arrangement, said attachment flange of each of said members is connected to said main portion of an associated one of said members remotely from said attachment flange thereof and wherein, in said second arrangement, said attachment flange of each of said members is connected to said main portion of said associated one of said members adjacent said attachment flange thereof.

5. A stand as set forth in claim 1 wherein one of said third and fourth edges constitute a lower edge and wherein each of said first flanges includes an integral leg portion extending downwardly below said lower edge.

6. A stand as set forth in claim 1 wherein one of said third and fourth edges constitutes an upper edge and wherein each of said upper edges has therein an upwardly opening groove located remotely from said attachment flange and adapted to receive the base of a water heater.

7. A stand as set forth in claim 1 wherein each of said fasteners includes a nut and a bolt.

8. An adjustable stand in accordance with claim 1 wherein each of said members also includes thrid and fourth flanges extending respectively from said third and fourth edges.

9. A stand for supporting a water heater, said stand comprising three sheet-like members each including a substantially planar and generally rectangular main portion having first and second parallel edges and third and fourth parallel edges, a first flange extending generally perpendicularly from said main portion along said first edge, and an attachment flange extending at an angle of less than 90° to said main portion from said second edge, each of said attachment flanges being connected to an associated one of said members, and means for securing said attachment flanges to said members.

10. An adjustable stand in accordance with claim 9 wherein each of said members also includes thrid and fourth flanges extending respectively from said third and fourth edges.

11. A stand as set forth in claim 9 wherein said main portion of each of said members extends substantially vertically.

12. A stand as set forth in claim 11 wherein said main portions define a substantially equilateral triangle.

13. A stand as set forth in claim 9 wherein one of said third and fourth edges constitute a lower edge and wherein each of said fourth flanges includes an integral leg portion extending downwardly below said lower edge.

14. A stand as set forth in claim 9 wherein one of said third and fourth edges constitutes an upper edge and wherein each of said upper edges has therein an upwardly opening groove located remotely from said attachment flange and adapted to receive the base of a water heater.

15. An adjustable stand for supporting water heaters of various sizes, said adjustable stand comprising three sheet-like members each defining a substantially vertical plane, said members being positionable in a first arrangement to support a water heater having a first width and in a second arrangement to support a water heater having a second width, said members defining an equilateral triangle when said members are in both said first and second arrangements, each of said members including a substantially planar and generally rectangular main portion having first and second parallel edges, and third and fourth parallel edges, a first flange extending from said main portion along said first edge, and an attachment flange extending at an angle of less than 90° to said main portion from said second edge, said attachment flanges respectively engaging an associated one of said members adjacent said attachment flanges thereof when said members are in said first arrangement, and said attachment flanges respectively engaging said associated one of said members adjacent said first flange thereof when said members are in said second arrangement, and user adjustable means including a plurality of fasteners for selectively securing said attachment flanges to said members in either of said first and second arrangements.

16. An adjustable stand in accordance with claim 15 wherein each of said members also includes thrid and fourth flanges extending respectively from said third and fourth edges.

17. An adjustable stand as set forth in claim 15 wherein said stand is invertible.

* * * * *